United States Patent [19]

Auten

[11] 4,212,913

[45] Jul. 15, 1980

[54] ROOF COATING SYSTEM

[76] Inventor: Jerry P. Auten, Rte. 6, Box 752, Charlotte, N.C. 28204

[21] Appl. No.: 39,805

[22] Filed: May 17, 1979

[51] Int. Cl.[2] ..... B32B 7/00

[52] U.S. Cl. ..... 428/251; 428/259; 428/258; 428/268; 428/273; 428/441

[58] Field of Search ..... 428/251, 268, 273, 441, 428/228, 245, 260, 247, 257, 258, 259

[56] References Cited

U.S. PATENT DOCUMENTS

| | | | |
|---|---|---|---|
| 3,395,069 | 7/1968 | Plueddemann | 428/251 |
| 3,398,044 | 8/1968 | Plueddemann | 428/273 |

*Primary Examiner*—James J. Bell

*Attorney, Agent, or Firm*—Richards, Shefte & Pinckney

[57] ABSTRACT

A roof coating system having an underlayer of coating material, an intermediate layer of woven fiber glass fabric that includes strands of bulked yarn in a relatively loose weave, and an overlayer of coating material, with the fiber glass fabric being embedded in the coating system between the underlayer and overlayer. The coating material of the underlayer and overlayer contains water, a high solids thermoplastic acrylic emulsion, calcium carbonate, titanium dioxide, sodium salt of polymeric carboxylic acid, a wetting, emulsifying and stabilizing agent and defoamers, with zinc oxide being used if desired for mildew resistance.

12 Claims, 5 Drawing Figures

FIG. 1
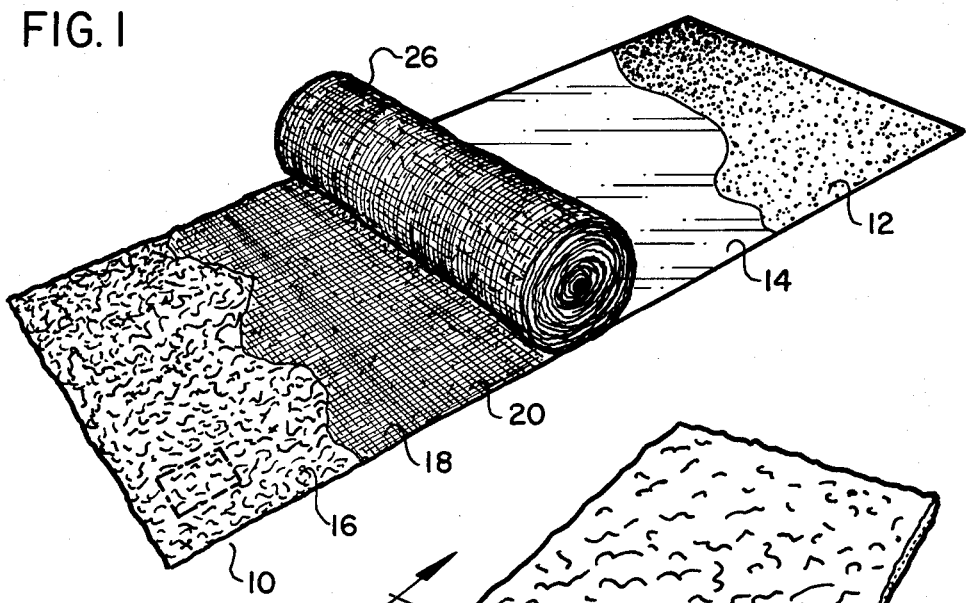
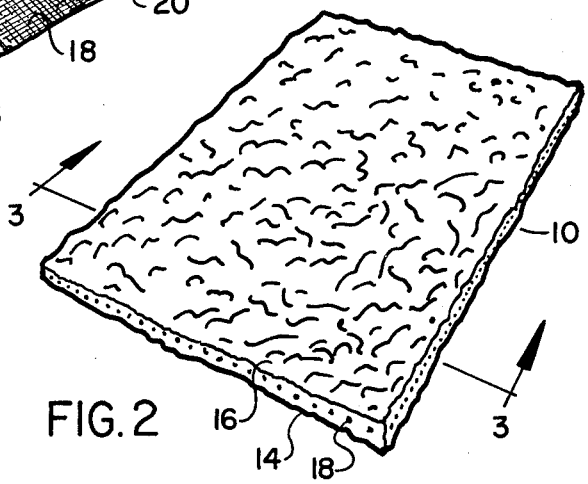
FIG. 2
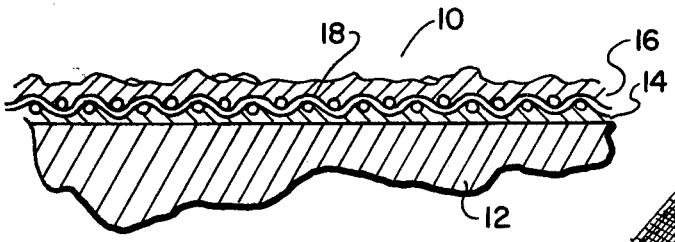
FIG. 3
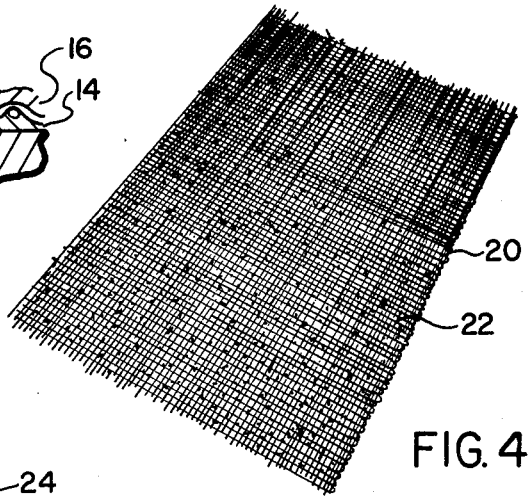
FIG. 4
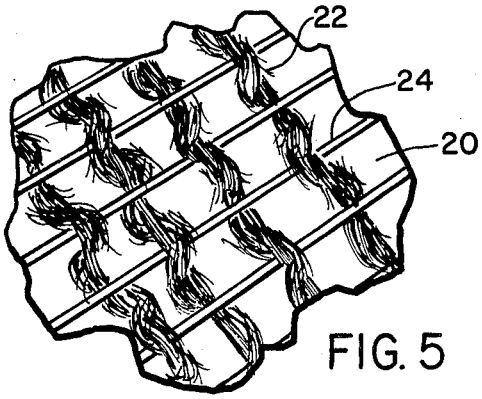
FIG. 5

ROOF COATING SYSTEM

BACKGROUND OF THE INVENTION

The present invention relates to roof coating systems, and more particularly to roof coating systems having reinforcement material embedded therein, which in combination with the coating material of the system provides high tensile strength and resilience such as to effectively minimize subsequent splitting, "alligatoring," wrinkling and blistering, and provide stable cover of pre-existing splits, "alligatoring," wrinkling and blistering.

As used here, the term "alligatoring" means localized cracks developed from repeated contraction and expansion due to weather conditions and the drying of asphaltic and coal tar.

Numerous roof coating systems have been developed over the years in an attempt to obtain the best combination of results. Various compositions have been used, including acrylic emulsions and various filler and reinforcing material has been used, including fiber glass fibers to provide strength and resilience. Such fiber glass fibers have been used in acrylic emulsions for reinforcement and resilience. Also, bulked fiber glass sheets have been used for similar purposes in cementitious compositions for roof coating systems. Further, conventional non-bulked fiber glass yarn in woven sheets have been used in acrylic emulsions.

These various roof coating system combinations have provided varying degrees of coverage and protection against splitting, "alligatoring," wrinkling and blistering and in covering old roof systems having these problems, but none of them has proven fully satisfactory to the extent necessary for desired results. Heretofore, best results have been obtained using an acrylic emulsion with conventional woven non-bulked fiber glass in a particular acrylic emulsion composition, which has been satisfactory in covering level uniform new surfaces, but has not been satisfactory for recovering non-uniform surfaces.

In contrast, the present invention provides excellent roof protection without subsequent development of splits, "alligatoring," wrinkling or blistering, and particularly provides stable long-lasting coverage of existing defects on pre-existing roof surfaces such that the system is universally applicable to new roofs and recovering of existing roof systems without notable disadvantages, particularly avoiding splitting, "alligatoring," wrinkling and blistering and short wear life.

SUMMARY OF THE INVENTION

Basically described, the present invention provides a roof system of high tensile strength and resilience and comprises an underlayer of coating material, an intermediate layer of woven fiber glass fabric, and an overlayer of coating material bonded to the underlayer with the intermediate fiber glass fabric layer embedded between the underlayer and the overlayer. The woven fiber glass fabric includes strands of bulked yarn in a relatively loose weave. The coated material is an acrylic resin emulsion.

Preferably, the intermediate layer of woven fiber glass fabric has strands of bulked yarn as the filling ends of the fabric and strands of non-bulked yarn as the warp ends of the fabric. Also, preferably, the coating material includes water, a high solids thermoplastic acrylic emulsion, calcium carbonate, titanium dioxide, sodium salt of polymeric carboxylic acid, a wetting, emulsifying and stabilizing agent and defoamers.

In the preferred embodiment, the woven fiber glass fabric has a weight of approximately four ounces per square inch with approximately eighteen warp ends per inch and fifteen filling ends per inch, both warp and filling ends being one hundred fifty denier single yarn with a twist of approximately 0.7 turns per inch. Also, in the preferred embodiment, the coating material components are combined in relative approximate quantities of seventy gallons of water, fifty-five gallons of high solids thermoplastic acrylic emulsion, five hundred pounds of calcium carbonate, fifty pounds of titanium dioxide, 4.8 pounds of sodium salt of polymeric carboxylic acid, 1.4 pounds of octyl phenol polyethoxy ethanol and one gallon of defoamers.

If desired for quicker setting in cooler spring and fall months particularly, the water content can be reduced by approximately 25% to 30%. The composition can also be varied by adding zinc oxide for mildew resistance.

BRIEF DESCRIPTION OF THE DRAWINGS

FIG. 1 is a perspective view of the sequence of producing the roof coating system of the present invention in a manner showing the underlayer, intermediate layer and overlayer of the system as it is applied to a roof;

FIG. 2 is an enlarged perspective view of a portion of the completed part of the roof coating system of the present invention as marked by the rectangle in FIG. 1;

FIG. 3 is an enlarged vertical section of the roof coating system of the present invention as taken along line 3—3 of FIG. 2;

FIG. 4 is an enlarged perspective view of the bulked woven fiber glass fabric of the intermediate layer of the roof coating system of the present invention; and FIG. 5 is an enlarged perspective view of the fabric of FIG. 4 showing the woven yarn construction in detail.

DETAILED DESCRIPTION OF THE PREFERRED EMBODIMENTS

Referring to the drawings, the roof coating system 10 of the preferred embodiment of the present invention is illustrated in completed form in FIGS. 2 and 3, FIG. 2 being a portion of the roof coating system as applied to a roof 12, and FIG. 3 being a cross-section of the roof system 10 of FIG. 2.

The roof coating system 10 includes an underlayer 14 of coating material of acrylic resin emulsion that is bonded to the surface of the roof 12. An overlayer 16 of the same coating material as the underlayer 14 is located on top and bonded to the underlayer 14. Disposed in the bond between the underlayer 14 and the overlayer 16 is an intermediate layer 18 of woven fiber glass fabric 20.

The acrylic resin emulsion of the coating material of the underlayer 14 and overlayer 16 provides better strength in resistance to the aforementioned conventional defects than other generally known prior coating materials, but is still susceptible when used by itself to possible splitting, "alligatoring," wrinkling and blistering with age, particularly after considerable temperature fluctuations. However, the woven fiber glass fabric 20 of the intermediate layer 18 enhances substantially the tensile strength and resilience of the overall roof coating system 10 to provide substantially improved resistance to splitting, "alligatoring," wrinkling and blistering under normal weather and wear conditions such that this new system provides results generally free of the short term results of weather and wear occasioned with the use of the mentioned prior art systems.

This enhanced tensile strength and resilience in the combined coating material and fiber glass fabric system of the present invention is obtained by using a woven fiber glass fabric in which strands of conventional bulked fiber glass yarn 22 are woven in a relatively loose weave. In the preferred embodiment of the present invention, the filling ends of the woven fabric are made with the strands of bulked yarn 22 and the warp ends are made of non-bulked fiber glass yarn 24. Both the yarns 22 and 24 are 150 denier single end yarn with a twist of approximately 0.7 turns per inch woven with approximately 18 warp ends per inch and approximately 15 filling ends per inch, and resulting in a fabric weight of approximately four ounces per square inch.

The particular construction of the woven fiber glass fabric 20 provides a losseness of weave sufficient for strong bonding of the underlayer 14 to the overlayer 16 with the intermediate layer 18 embedded therein and the bulked characteristic of the yarn 22 enhances the bonding of the fabric 20 in the system 10. With this bulked fiber glass yarn fabric and the embedded arrangement, sufficient tensile strength and resilience are provided in a combination that resists undue localized stress that produces the aforementioned conventional defects. Rather, the tendency towards localized stress is dissipated and resisted by the fabric and emulsion combination.

The coating material of the underlayer 14 and overlayer 16 that provides the results attributable to the present invention includes water, high solids thermoplastic acrylic emulsion, calcium carbonate, titanium dioxide, sodium salt of polymeric carboxylic acid, a wetting, emulsifying and stabilizing agent, and defoamers.

In the preferred embodiment of the present invention the wetting, emulsifying and stabilizing agent is octyl phenol polyethoxy ethanol and the components of the coating material are included in the following approximate percentages by weight:

| | |
|---|---|
| Water | 36.0% |
| High solids thermoplastic acrylic emulsion | 29.0% |
| Calcium carbonate | 31.0% |
| Titanium dioxide | 3.0% |
| Sodium salt of polymeric carboxylic acid | 0.3% |
| Octyl phenol polyethoxy ethanol | 0.1% |
| Defoamers | 0.5% |

The water acts as a carrier for all of the other ingredients and is evaporated out of the material upon drying.

The high solids thermoplastic acrylic emulsion serves as a binder for all the other ingredients and bonds the layers of the system together and to the roof. In the preferred embodiment this component is Rhoplex LC-67 sold by Rohm and Haas Company of Philadelphia, Pennsylvania, which is conventionally sold for the formulation of pressure-sensitive and lamenating adhesives.

The calcium carbonate serves as a filler to build up the total solids of the coating material and to reduce the surface tack of the aforementioned acrylic emulsion. It is primarily inert in the completed system.

The titanium dioxide is a pigment that functions to give whiteness and brightness to the coating and also provides hiding or covering power.

The sodium salt of polymeric carboxylic acid serves to disburse the titanium dioxide pigment in the coating material. Preferably Tamol 850 sold by Rohm and Haas Company is used for this component. Tamol 850 is a clear aqueous solution of a very low-foaming light-colored dispersant which is conventionally useful in maintaining low viscosity, both in high-solids clay slurries and in clay coating.

The octyl phenol polyethoxy ethanol component serves as a pigment wetting agent, emulsifier and stabilizing agent for the coating material. Preferably Triton X405 sold by Rohm and Haas Company is used for this component.

The defoamers may be any conventional defoamers compatible with the other components of the coating material. In the preferred embodiment, the conventional defoamer used is Nopco NXZ sold by Nopco Chemical Company of Charlotte, North Carolina.

In addition to the above components, zinc oxide may be added to provide resistance to mold and mildew. Of course, the amount of this component may be varied or omitted as desired for particular results. In hot humid climates as much as 3% to 5% by weight of zinc oxide may be used. In less hot and humid climates half this amount may be all that is preferred, and in come climates no zinc oxide at all may be desired.

Also, the amount of calcium carbonate may be varied. When the amount of calcium carbonate is increased, the surface tack of the system is decreased, the coating thickness increased, dirt collection on the material surface decreased and water evaporation and drying increased for a faster set. Decreasing the amount of calcium carbonate would obviously have the reverse effects.

The water content is preferably reduced in cool humid weather, such as in spring and fall to facilitate proper drying without a prolonged drying period. Preferably this reduction of water content is in the range of 25 to 30% of the amount mentioned hereinabove, but a lesser decrease or no decrease can be used suit particular weather conditions. In this regard, sufficient water content is necessary to avoid too fast drying that could prevent proper lamination of the fiber glass fabric in the underlayer.

The roof coating system 10 of the present invention is applied to a roof 12 by first applying the coating material by spray, brush or roller and while this is being done immediately follow up with the laying of the intermediate layer 18 of fiber glass fabric by unrolling from a roll 26 (see FIG. 1). The fiber glass fabric 20 is then gently brushed with a broom into the wet underlayer 14. The coating material of the overlayer 16 is then applied in the same manner as the underlayer 14 immediately following the application of the fabric 20. On hot dry days the overlayer 16 may be applied as soon as the fiber glass fabric 20 has been applied, but on cool humid days a time interval may be necessary, sometimes as much as a full day. Preferably the overlayer 16 is applied in two coats, with the second coat following the first coat immediately after completion of the first coat application to the roof, but in cool humid weather the second coat can be delayed for hours or a day or even longer to suit weather conditions or for convenience.

Typical examples of the formulation and application of the preferred embodiments of the present invention are as follows:

EXAMPLE I

A batch of coating material is prepared from the following components in the indicated relative approximate quantities:

| | |
|---|---|
| Water | 70 Gallons |
| High solids thermoplastic acrylic emulsion (Rhoplex LC-67) | 55 Gallons |
| Calcium carbonate | 500 Pounds |
| Titanium dioxide | 50 Pounds |
| Sodium salt of polymeric carboxylic acid (Tamol 850) | 4.8 Pounds |
| Octyl phenol polyethoxy ethanol (Triton X-405) | 1.4 Pounds |
| Defoamers (Nopco NXZ) | 1 Gallon |

This coating material is sprayed on a roof surface in an amount of approximately five gallons per 100 square feet. As the spraying of the underlayer continues, the fiber glass fabric 20 of the preferred embodiment described above is unrolled from a roll 26 onto the underlayer 14 and it is gently brushed with a broom to force it into the still wet underlayer. In warm dry weather the coating material is then sprayed on top of the underlayer 14 and fabric 20 to form the first coat of the overlayer 16 and a second coat is then applied after the spraying of the first coat has been completed.

EXAMPLE II

The coating material of Example I is prepared adding 75 pounds of zinc oxide for use in a humid climate where mildew resistance is important. The application procedure described in Example I is followed except that a full day drying time is allowed between application of the first and second coats of the overlayer 16.

EXAMPLE III

The coating material of Example I is prepared, with the exception that 50 gallons of water are used instead of 70 gallons. This coating material is intended for application in cooler drier weather, such as in northern climates or in spring and fall in southern climates. It is applied in the same manner as described in Example I with a one day delay between application of the two coats of the overlayer 16.

The foregoing detailed description and examples are provided for illustrative purposes only and are not intended to be limiting as to the scope of the present invention. Various modifications and variations are comtemplated within the scope of the present invention, which is intended to be limited only by the scope of the accompanying claims.

I claim:

1. A roof coating system of high tensile strength and resilience comprising an underlayer of coating material, an intermediate layer of woven fiber glass fabric, and an overlayer of said coating material bonded to said underlayer with said intermediate fiber glass fabric layer embedded between said underlayer and overlayer, said woven fiber glass fabric including strands of bulked yarn in a relatively loose weave, and said coating material comprising an acrylic resin emulsion.

2. A roof coating system according to claim 1 and characterized further in that said intermediate layer of woven fiber glass fabric comprises said strands of bulked yarn as the filling ends of said fabric and strands of non-bulked yarn as the warp ends of said fabric.

3. A roof coating system according to either claim 1 or claim 2 and characterized further in that said woven fiber glass fabric has a weight of approximately 4 ounces per square inch.

4. A roof coating system according to either claim 1 or claim 2 and characterized further in that said woven fiber glass fabric comprises approximately 18 warp ends per inch and approximately 15 filling ends per inch.

5. A roof coating system according to either claim 1 or claim 2 and characterized further in that said woven fiber glass fabric comprises filling ends of 150 denier single yarn with a twist of approximately 0.7 turns per inch and warp ends of 150 denier single yarn with a twist of approximately 0.7 turns per inch.

6. A roof coating system according to claim 1 and characterized further in that said coating material comprises water, a high solids thermoplastic acrylic emulsion, calcium carbonate, titanium dioxide, sodium salt of polymeric carboxylic acid, a wetting, emulsifying and stabilizing agent and defoamers.

7. A roof coating system according to claim 1 and characterized further in that said coating material comprises in approximate percentages by weight:

| | |
|---|---|
| Water | 36% |
| High solids thermoplastic acrylic emulsion | 29% |
| Calcium carbonate | 31% |
| Titanium dioxide | 3% |
| Sodium salt of polymeric carboxylic acid | 0.3% |
| Wetting, emulsifying and stabilizing agent | 0.1% |
| Defoamers | 0.5% |

8. A roof coating system according to either claim 6 or claim 7 and characterized further in that said wetting, emulsifying and stabilizing agent is octyl phenol polyethoxy ethanol.

9. A roof coating system according to claim 1 and characterized further in that said coating material comprises the following components in the relative approximate quantities indicated:

| | |
|---|---|
| Water | 70 Gallons |
| High solids thermoplastic acrylic emulsion | 55 Gallons |
| Calcium carbonate | 500 Pounds |
| Titanium dioxide | 50 Pounds |
| Sodium salt of polymeric carboxylic acid | 4.8 Pounds |
| Octyl phenol polyethoxy ethanol | 1.4 Pounds |
| Defoamers | 1 Gallon |

10. A roof coating system according to either claim 7 or claim 9 and characterized further in that the water content of said coating material is reduced to approximately 50 gallons.

11. A roof coating system according to claim 6 and characterized further in that said coating material includes zinc oxide for mildew resistance.

12. A roof coating system according to claim 9 and characterized further in that said coating material includes zinc oxide in an amount of 25–75 pounds.

* * * * *